United States Patent [19]

Akkerman

[11] 4,325,431

[45] Apr. 20, 1982

[54] FLOW CONTROLLING APPARATUS

[75] Inventor: Neil H. Akkerman, Kingwood, Tex.

[73] Assignee: Ava International Corporation, Houston, Tex.

[21] Appl. No.: 168,435

[22] Filed: Jul. 10, 1980

[51] Int. Cl.[3] ..... E21B 23/03; E21B 34/10

[52] U.S. Cl. ..... 166/117.5; 166/321; 166/242

[58] Field of Search ..... 166/117.5, 324, 319, 166/321, 322, 242, 334, 332

[56] References Cited

U.S. PATENT DOCUMENTS

| | | | |
|---|---|---|---|
| 2,780,290 | 2/1957 | Natho | 166/319 X |
| 3,071,151 | 1/1963 | Sizer | 166/324 X |
| 3,078,923 | 2/1963 | Tansch | 166/322 |
| 3,627,042 | 12/1971 | McGowen, Jr. et al. | 166/322 |
| 3,665,955 | 5/1972 | Conner, Sr. | 166/117.5 X |
| 3,865,141 | 2/1975 | Young | 166/324 X |
| 3,958,633 | 5/1976 | Britch et al. | 166/117.5 |
| 4,119,146 | 10/1978 | Taylor | 166/321 X |
| 4,161,219 | 7/1979 | Pringle | 166/324 |
| 4,224,986 | 9/1980 | Rothberg | 166/117.5 |

*Primary Examiner*—Stephen J. Novosad
*Attorney, Agent, or Firm*—Vaden, Eickenroht, Thompson, Bednar & Jamison

[57] ABSTRACT

There is disclosed a subsurface safety valve having a closure member which is yieldably urged to a position closing a bore through a mandrel connected as a part of a well tubing string, but adapted to be opened by means of a piston carried by a wire line retrievable tool landed within a pocket to one side of the bore and movable in a direction to open the closure member in response to the supply of control fluid to one side thereof from a remote source. The pocket and an intermediate portion of the bore are formed within a thickened wall of an inner body of the mandrel which fits within the inner diameter of an outer body of the mandrel whose opposite ends are connected to the tubing, so that the axis of the inner body is eccentric with respect to the axes of the bore and pocket, and means are provided for threadedly connecting the inner body in a fixed vertical position within the outer body.

16 Claims, 18 Drawing Figures

T
32B
32
35
25A
20
34
M
36
38
26
53
22
33A
3
3
32
33
54
32A
3A
3A
33
25C
31
28
29
M
30
23
62
49
32
25B
37
T
33C
32
26
42
20
33B
33
40
32B
41
M
25C
F
29
30
23

Fig. 8
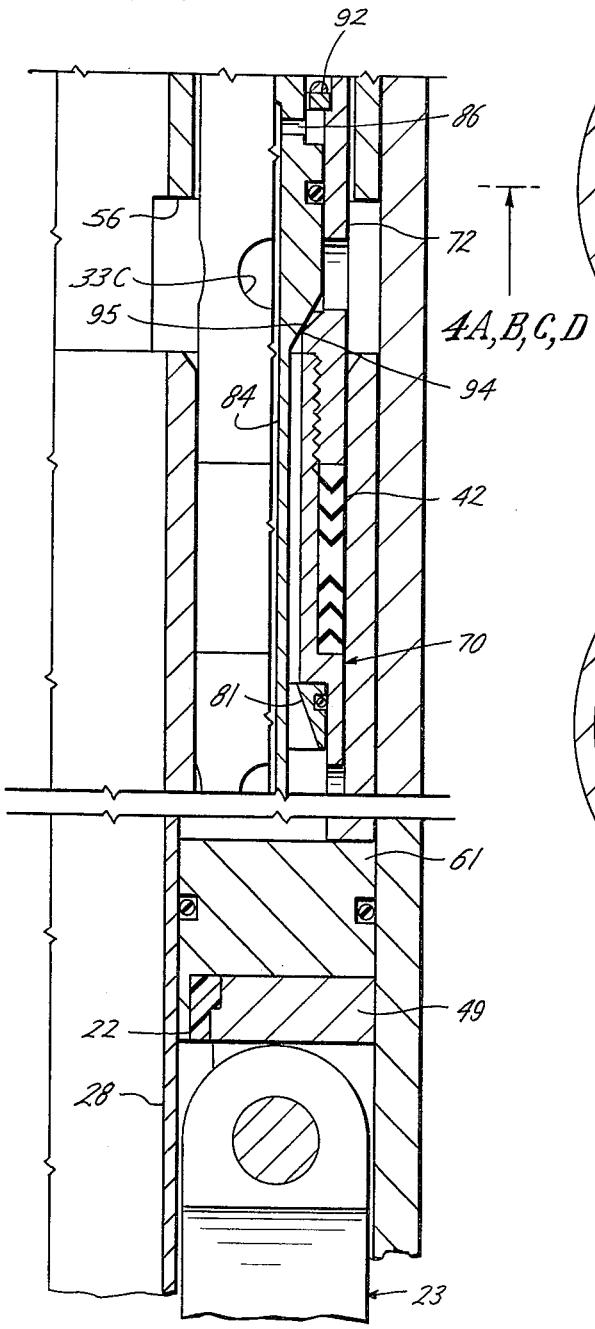
Fig. 3
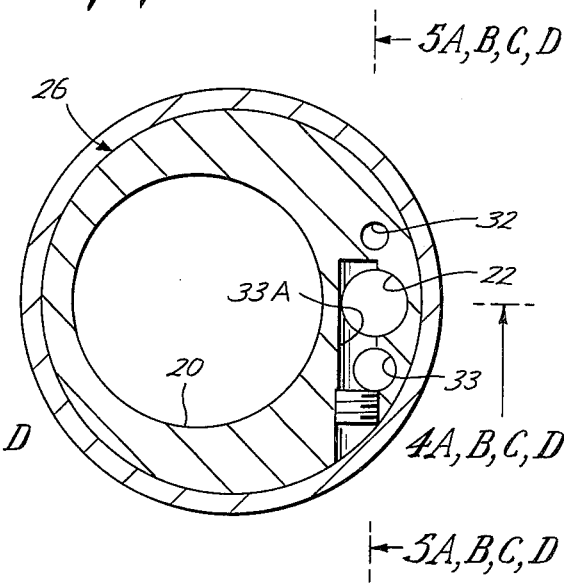
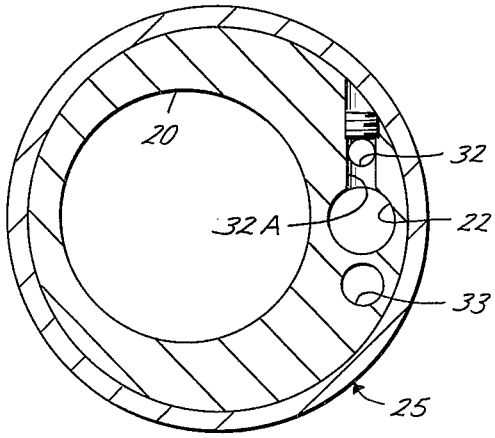
Fig. 3A

5A, B, C, D 71
37
22A
38
37A
93
91
90
92
86
83

94
56
33C
95
72
76
84
42
77
70
81
80
22
96
33A
33B
97
82
85
40
73
75A
32A
32B
41

FLOW CONTROLLING APPARATUS

This invention relates generally to apparatus which is adapted to be connected in a well pipe string for the purpose of controlling the flow of fluid within the well. In one of its aspects, it relates to improvements in apparatus of this type known as a subsurface safety valve which opens and closes a tubing string in order to control the flow of oil or gas to be produced from the well. In another of its aspects, it relates to improvements in apparatus of this type which includes what is known as a side pocket mandrel in which a tool may be landed by wire line or other means.

Subsurface safety valves are of either the tubing mounted or wire line retrievable type. Tubing mounted valves are often preferred because, when open, they provide a full opening through the tubing to permit wire line operations below the valve. However, since the closure member is mounted in the tubing string, the parts for operating it, and particularly their dynamic seals, may not be retrieved for replacement or repair without pulling the tubing string. Although wire line retrievable valves of this type are often preferred because they do permit the closure member and its operating parts to be retrieved, they nevertheless obstruct the tubing bore so that they must be removed to permit certain wire line operations beneath the valve.

In a typical subsurface safety valve of the tubing mounted type, the closure member, which may be a flapper or a ball having a through port, is urged toward closed position by a spring or other biasing means. Under normal conditions, the closure member is held open by control fluid which is supplied from a suitable source at the subsurface level through a conduit extending downwardly along the tubing. In the event of an abnormal condition, such as shearing of the tubing and control fluid conduit above the valve, whereby the force holding the closure member in open position is lost, the spring automatically moves the closure member to closed position, and in this sense the valve fails closed.

When the valve closes, tubing pressure beneath it is effective over the lower side of the entire area of the closure member so that the force due to control fluid, which acts over one side of a piston to operate the closure member, is opposed by a relatively large force holding the valve closed. Consequently, valves of this type also have means which fluidly connects the tubing above and below the closure member, and thus equalizes pressure thereacross, automatically in response to the supply of control fluid at a pressure sufficient to initiate movement of the piston in a direction to open the closure member. Thus, the force necessary to open the valve need only be that required to overcome the pressure of fluid within the tubing acting over the other side of the piston.

An object of this invention is to provide a subsurface safety valve which has the advantages of both the tubing mounted and the wire line retrievable type, without the disadvantages of either, in that it provides a full opening therethrough, while, at the same time, permitting at least some and preferably all of the parts for operating the closure member to be retrieved and repaired or replaced without pulling the entire tubing string.

This and other objects are accomplished, in accordance with the illustrated embodiment of the present invention, by a subsurface safety valve having a mandrel with a bore therethrough whose axis is adapted to be substantially aligned with the axis of a tubing string when the mandrel is connected as part of the string, and a closure member which is mounted within the mandrel for movement between positions opening and closing the bore, and which, as in valves of this type, is yieldably urged to its closed position. The valve also includes a tool which is adapted to be moved vertically through the tubing string into and out the open end of a pocket on one side of the bore to permit it to be landed within or retrieved from the pocket. More particularly, the piston for operating the closure member is carried by the tool and is responsive to the supply of control fluid thereto from a remote source, when the tool is landed in the pocket, for moving the closure member to open position.

In the preferred and illustrated embodiment of the invention, means comprising conduits within the tool and mandrel are provided for fluidly connecting the mandrel bore above and below the closure member so as to equalize pressure thereacross when the closure member is closed. More particularly, a valve means within the tool which normally closes the conduits is adapted to open automatically in response to the supply of control fluid in order to move the piston in a direction to open the closure member. Thus, as in prior valves of this type, well tubing pressure across the closure member is equalized so as to enable the piston to open the closure member with a minimum of force.

As illustrated, the tool for operating the closure member includes a body which, when landed in the pocket, forms with said pocket a control fluid chamber having one wall which comprises one side of the piston which is responsive to control fluid in said chamber to move the piston in one direction to open the closure member, and an opposite side of the piston being responsive to the pressure of well fluid in the bore of the mandrel for urging it in the opposite direction to permit the closure member to be closed. Thus, the means for supplying control fluid to the tool includes a port in the mandrel connecting with the pocket so that control fluid may be supplied from the remote source to the control fluid chamber.

Side pocket mandrels are normally formed of a pair of side-by-side tubular members, one of which has the through bore formed therein and the other of which has the pocket formed therein. The side of the bored member is normally slotted along a mid portion of its length to receive one side of the other tubular member, and, when so assembled, the members are welded to one another. However, it may be desirable to form the tubing of a steel whose crystalline structure may be upset by welding. Also, welding of the tubular members may distort them to such an extent that they are misaligned—e.g., the axis of the through bore and pocket are not substantially parallel. In some applications, such as the subsurface safety valve above described, this substantial axial misalignment could interfere with the necessary cooperation between parts movable along the axes of the bore and pocket.

It is therefore another object of this invention to provide such a mandrel for a subsurface safety valve or other flow controlling apparatus which does not require welding, and, more specifically, whose construction permits both the bore and the pocket to be machined in a single piece to thereby assure their axial alignment.

This and other objects are accomplished, in accordance with the illustrated embodiment of the invention, by apparatus of the type described wherein the mandrel has means at its opposite ends for connecting it as part of a tubing string and a bore therethrough adapted to be substantially aligned with the axis of the string when the mandrel is so connected, the mandrel having a portion intermediate its ends whose outer diameter is eccentric to the axis of its bore, and the bore being adapted to be opened and closed by means of a closure member mounted within the mandrel and yieldably urged to closed position. Means including a control fluid chamber is formed within the thickened wall of the intermediate portion of the mandrel to one side of the bore for moving the closure member to open position in response to the supply of control fluid to such chamber, and means is provided for supplying control fluid from a remote source to the piston. Consequently, in the manufacture of the valve, the mandrel, including the parts from which it is constructed, requires no welding.

The means through which control fluid may be supplied to the control fluid chamber includes a conduit in the thickened wall of the mandrel to one side of the control fluid chamber and connecting with a port leading to the control fluid chamber. Preferably, the conduit in the mandrel through which well fluid from the bore of the mandrel beneath the closure member is supplied to the control fluid chamber includes another conduit in the thickened wall of the mandrel to the other side of the control fluid chamber. It is also contemplated, in accordance with the preferred and illustrated embodiment of the invention, that still another conduit be formed in the thickened wall of the mandrel to provide a continuation of the first-mentioned conduit to permit control fluid to be supplied to parts beneath the closure member.

Preferably, the mandrel includes an outer body with openings through its upper and lower ends which are connected in axial alignment with a well pipe string and an intermediate section having an inner, radially enlarged diameter which is eccentric to the axes of its end openings, and an inner body which fits within the inner diameter of the intermediate section of the body. More particularly, the inner body has a bore therethrough which is aligned with the axes of the end openings, and a pocket which is formed therein to one side of the bore with its axis parallel to the axis of the bore. More particularly, a means is provided for threadedly connecting the inner body in a fixed vertical position within the outer body, thus avoiding a welded connection between the bodies. The upper end of the pocket opens to the intermediate section of the outer body so that the operating tool may be run into and retrieved from a landed position within the pocket. Inasmuch as both the bore and pocket are formed in the inner body, machining of such bores is simplified.

In the drawings, wherein like reference characters are used throughout to designate like parts:

FIGS. 3 and 3A are cross-sectional views of an intermediate portion of the mandrel, on a larger scale, and as seen along broken lines 3—3 and 3A—3A, respectively, of FIGS. 1A and 1B;

Figure 7:
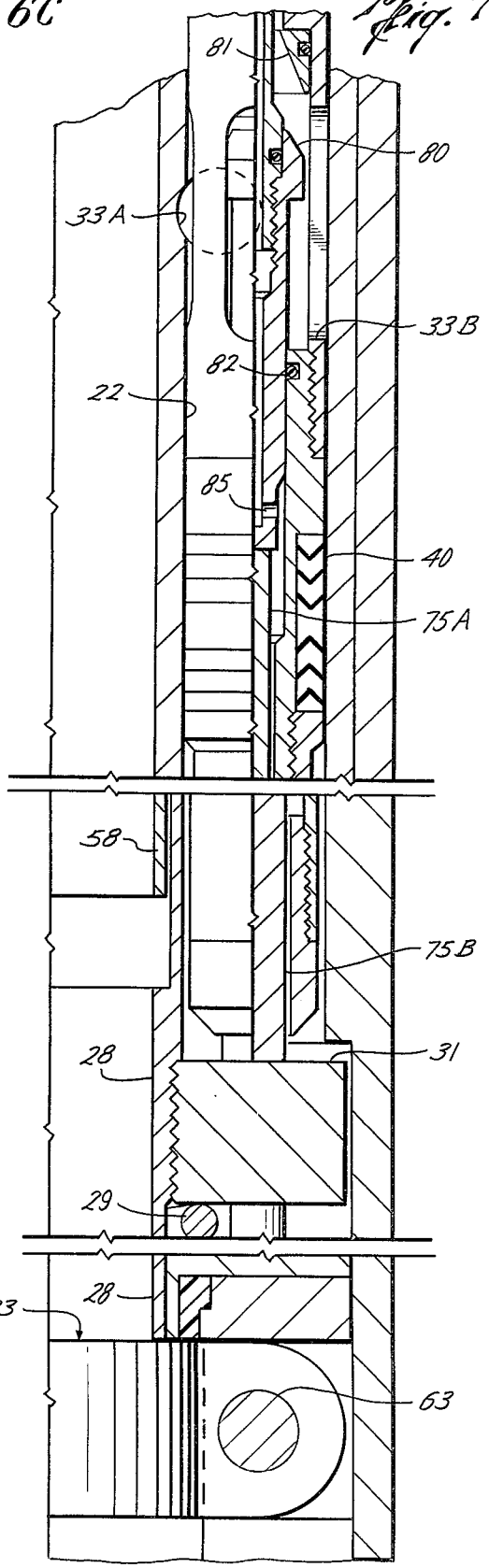

FIG. 7 is another partial vertical sectional view of intermediate portions of the mandrel and the operating tool, interrupted along their lengths, and with the piston of the operating tool extended to lower the actuator into engagement with the closure member, and the equalizing valve moved to open position; and FIG. 8 is still another partial vertical sectional view, similar to FIG. 7, but upon further extension of the piston to open the closure member, and with the equalizing valve moved a further distance to reclose the upper end of the control chamber within the operating tool.

Figures 1A, 1B, 2:
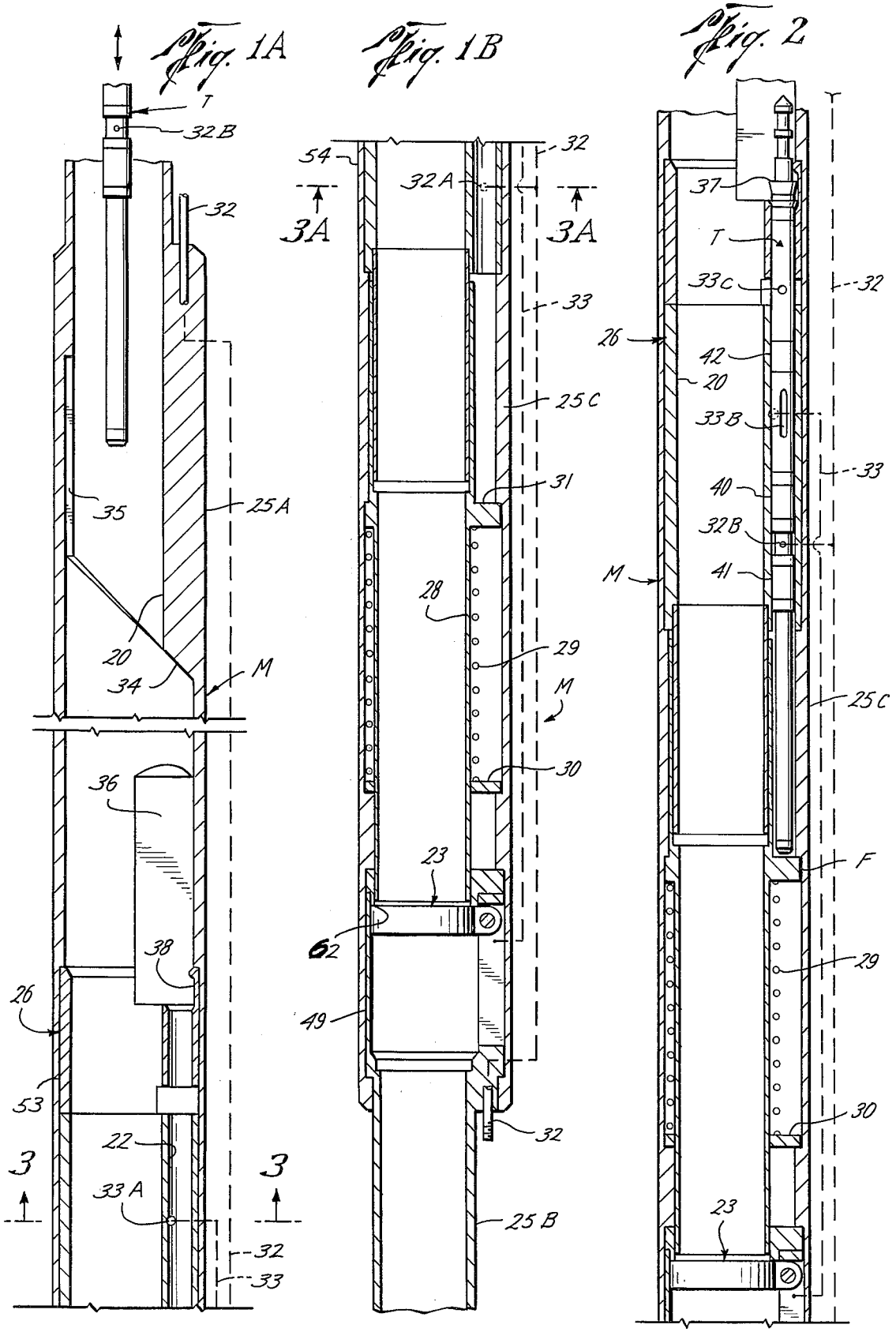
FIGS. 1A and 1B are vertical sectional views of the upper and lower portions, respectively, of a subsurface safety valve constructed in accordance with the present invention, with the operating tool thereof being shown as it is lowered through the bore of the upper portion into or out of landed position within a pocket to one side of the bore.
FIG. 2 is a vertical sectional view of the lower portion of the tool, similar to FIG. 1B, but with the operating tool landed within the pocket.

With reference now to the details of the abovedescribed drawings, the overall valve is shown diagrammatically in FIGS. 1A, 1B and 2 to include a mandrel M adapted to be connected as part of a well string (not shown) and having a bore 20 therethrough which, when the mandrel is so connected, is axially aligned with the well string. The valve also includes a closure member 23 mounted in the mandrel for movement between positions opening and closing the bore 20, and a tool T for use in operating the valve when landed in a pocket 22 of the mandrel to one side of the bore, as shown in FIG. 2. As previously described, the well string will, as a general rule, be the tubing string of an offshore oil or gas well, and the mandrel will be connected as part of the tubing string at just below the mud level.

As will be described in detail to follow, the closure member 23 is a flapper which is normally closed, but which, when moved to open position, as shown in FIG. 8, provides a full opening through the bore of the mandrel and the tubing string to permit wire line operations below the valve. The upper end of the pocket 22 is open, so that, in the event one or more parts of the operating tool, and especially the dynamic seals thereof, require replacement or repair, the tool need only be retrieved from the pocket 22, and then, when reconditioned, run back through the bore of the mandrel into landed position within the pocket, all in accordance with conventional wire line procedures.

The mandrel M includes an outer body 25 which is made up of sections connected in end-to-end relation, with the upper and lower sections 25A and 25B, respectively, having axially aligned end openings forming the upper and lower ends of the bore 20, and an intermediate section 25C having an inner diameter which is radially enlarged and eccentric to the axes of the end openings in the upper and lower sections. The mandrel also comprises an inner body 26 having an outer diameter which fits closely within the inner diameter of the upper portion of the intermediate inner body section 25C, and a bore therethrough which is axially aligned with the upper and lower sections of the outer body to form a continuation of bore 20. As shown, the pocket 22 of the mandrel is formed in the inner body to one side of its bore and thus eccentrically of the mandrel bore 20.

The valve actuator comprises a tube 28 which is axially reciprocable within the lower portion of the intermediate section of the outer mandrel body, and thus below inner body 26, between an upper position (FIGS. 1B and 2) in which its lower end is above the flapper 23, and a lower position (FIG. 8) in which it extends downwardly through the seat to open and hold the flapper to one side of the seat. In this latter position, the tube provides a substantially smooth continuation of the bore through the lower section 25C of the outer mandrel body.

A coil spring 29 is disposed within the space between the actuator tube 28 and the intermediate section 25C of the outer mandrel body, with the upper end of the spring engaging a ring 31 carried by the tube 28 and its lower end a ring or collar 30 supported on an upwardly facing shoulder of the outer mandrel body so as to urge the tube to its upper position. As shown in FIG. 2, when the operating tool T is landed within the side pocket 22, its lower end is disposed just above the ring 31 on the actuator tube so that when a piston is extended therefrom in response to control pressure, it will move the tube downwardly against the force of the spring 29 in order to open the closure member. Control fluid for extending the piston, and thus operating the closure member, is supplied to a pressure responsive area of the piston within a control pressure chamber of the tool through a conduit 32 extending downwardly from a suitable source at the surface to a port 32A (FIG. 1B) in the mandrel which connects with the side pocket. Thus, port 32A in the mandrel connects the lower end of the conduit 32 with a port 32B (FIG. 2) in the landed tool T intermediate the lower packings 40 and 41, respectively, about the body of the tool.

As also previously described, a means is provided for equalizing the pressure of well fluid above and below the closed flapper in response to the supply of control fluid to the control chamber of the operating tool at a pressure which initiates movement of the piston for lowering the actuator tube 28. For this purpose, another conduit 33 extends within the mandrel to connect the mandrel bore beneath the closed flapper with a port 33A (FIG. 1A) in the mandrel leading to the pocket 22 above the port 32A. A port 33A and slots 33B are formed in the tool body intermediate upper and intermediate packings 42 and 40, respectively, thereabout so as to direct well fluid from the tubing below the flapper into an annular conduit within the tool. The upper end of the latter conduit is in turn connected to a port 33C in the tool which leads to the mandrel bore above the flapper.

The conduit in the tool is normally closed but adapted to be opened by valve means in the tool in response to control fluid in the control chamber as the piston is moved downwardly in response thereto. Upon opening of the equalizing valve, well fluid beneath the flapper flows through the exterior conduit 33 as well as the tool conduit into the bore of the mandrel above the flapper. As previously described, this equalization of pressure enables the piston to extend further in response to control fluid in order to move the flapper to open position and extend through the seat 22 to hold the flapper in open position.

The upper end of tool T is specially prepared to receive releasable parts of a suitable wire line running tool, which, for example, may be of a type shown in U.S. Pat. No. 3,827,490. The bore 20 of mandrel M is prepared to cooperate with the running tool, during running of the operating tool T, to kick the operating tool over into a position above the upper end of the pocket, or, alternatively, during pulling of the operating tool T from the pocket, to kick the tool over into the mandrel bore. Thus, as shown in and for a purpose which will be apparent from U.S. Pat. No. 3,741,299, the lower end of an eccentrically formed portion of the upper section 25A of the outer mandrel body is tapered at 34 and has a slot 35 extending upwardly from the taper diametrically opposite to the pocket 22. As also explained in the latter patent, inserts are mounted on the intermediate section 25C just above the open upper end of the pocket to provide guide surfaces 36 which converge toward the pocket to prevent entry of tools other than tool T into positions above the pocket 22.

As the operating tool is lowered into pocket 22, a shoulder 37A thereabout lands upon a seat 22A about the pocket (see FIG. 6A), and a collar 37 beneath the neck at its upper end moves beneath an inner groove 38 formed in the upper end of the inner body 26 of the mandrel so as to limit upward movement of the tool from its landed position. As can be seen from FIGS. 1A and 2, the groove 38 is disposed at the convergence of the guide surfaces 36 just above the seat 22A.

Figures 4A, 5A:
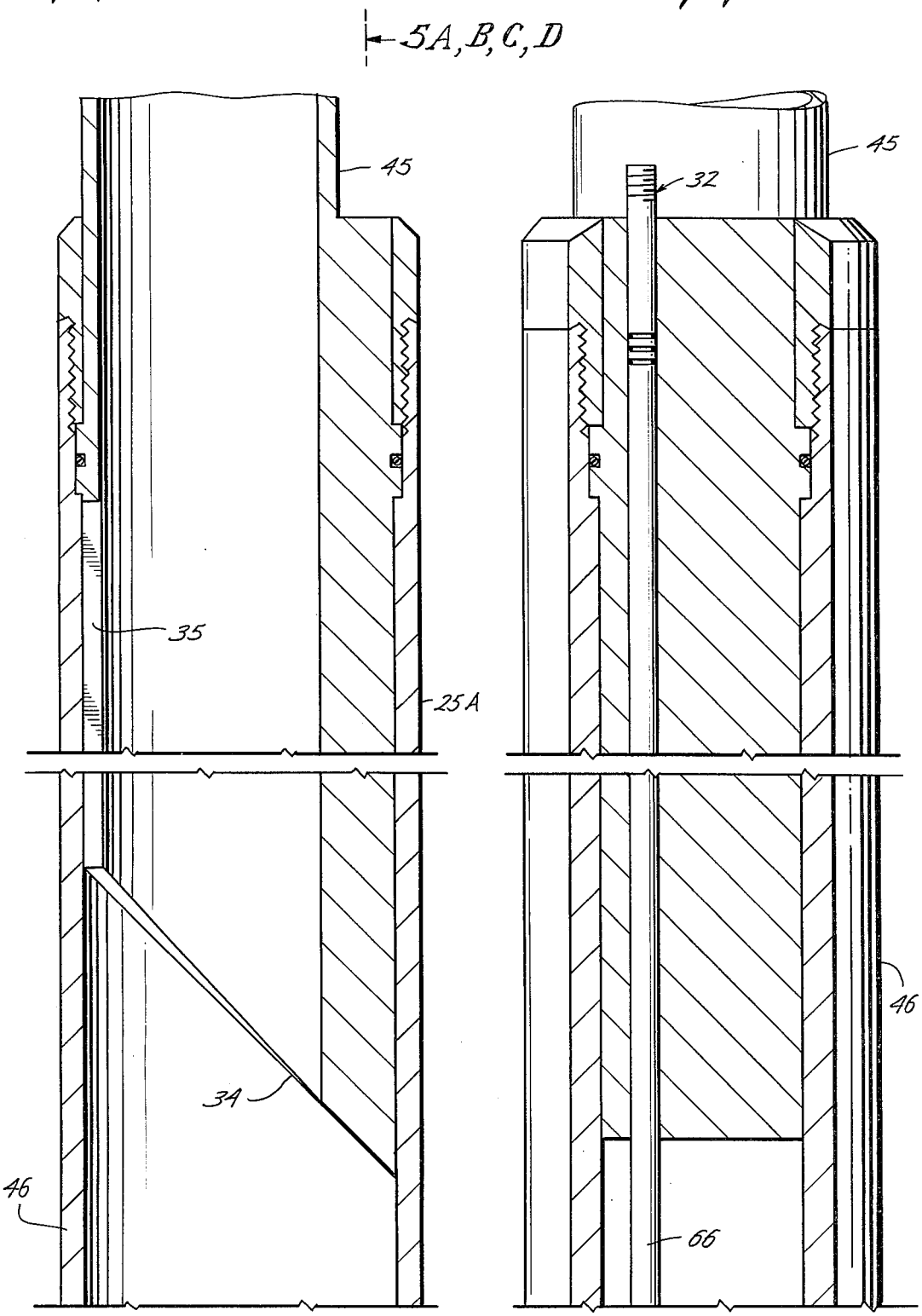
FIGS. 4A, 4B, 4C and 4D are vertical sectional views of portions of the mandrel from its upper to its lower end, on the larger scale of FIGS. 3 and 3A, and as seen along broken lines 4A,B,C,D—4A,B,C,D of FIG. 3.
FIGS. 5A, 5B, 5C and 5D are vertical sectional views of portions of the mandrel from its upper to its lower end, similar to FIGS. 4A, 4B, 4C and 4D, but as seen along broken lines 5-A,B,C,D—5A,B,C,D of FIG. 3.

With reference now to the detailed illustrations of FIGS. 4A, 4B, 4C, 4D and 5A, 5B, 5C and 5D, the upper section 25A of the outer mandrel body 25 includes an uppermost member 45 which is tubular at its upper end and eccentrically enlarged at its lower end. As previously described, the upper end of the tubular portion of member 45 is suitably prepared for connection with the tubing string. The outer diameter of the lower enlarged end of uppermost member 45 fits closely within the upper end of a tubular member 46 which is connected to and suspended from the member 45 in any suitable manner, such as shown in FIG. 4A. Tubular member 46 not only provides the lower end of the upper body section 25A, but also extends downwardly therefrom to provide the intermediate mandrel body section 25C.

The member 35 extends downwardly to receive the inner mandrel body 26, which will be described in detail to follow, and is connected at its lower end to another tubular member 47 of the mandrel body in which the spring 29 and actuator tube 28 are received. Still another tubular member 48 of the outer mandrel body is threadedly connected to the lower end of the member 47 to surround the flapper 23 and the assembly on which it is mounted for swinging between its open and closed position.

As will be described in detail to follow, the flapper mounting assembly includes a housing 49 which fits closely within and is suspended by tubular member 48 by means of a shoulder 50 thereabout which seats on an inwardly extending shoulder 51 on the lower end of member 48. As best shown in FIG. 4D, the upper portion of the housing has a bore therethrough which is coaxial of the mandrel bore 20 and is eccentric with respect to the outer diameter of such upper portion, and a lower tubular extension 52 which, with tubular members 47 and 48, forms the lowest section 25B of the outer mandrel body. The lower end of extension 52 has a bore therethrough which forms the lower end opening of the mandrel, and thus the lower end of the mandrel bore, and which is suitably prepared at its lower end for connection to the tubing string therebelow.

The inner mandrel body 26 comprises upper and lower sections 53 and 54, respectively, which are stacked one above the other and fit closely within the inner diameter of the lower end of the outer mandrel body member 46. More particularly, the sections of the inner mandrel body have axially aligned openings which form intermediate portions of the mandrel bore 20, and axially aligned openings forming the pocket 22 to one side of and parallel to the bore. The lower end of the lower section 54 is supported on the upper end of tubular member 47 of the outer mandrel body, and the upper end of the upper section 53 abuts a shoulder 55 about the inner diameter of an intermediate portion of tubular member 46.

Figure 4B:
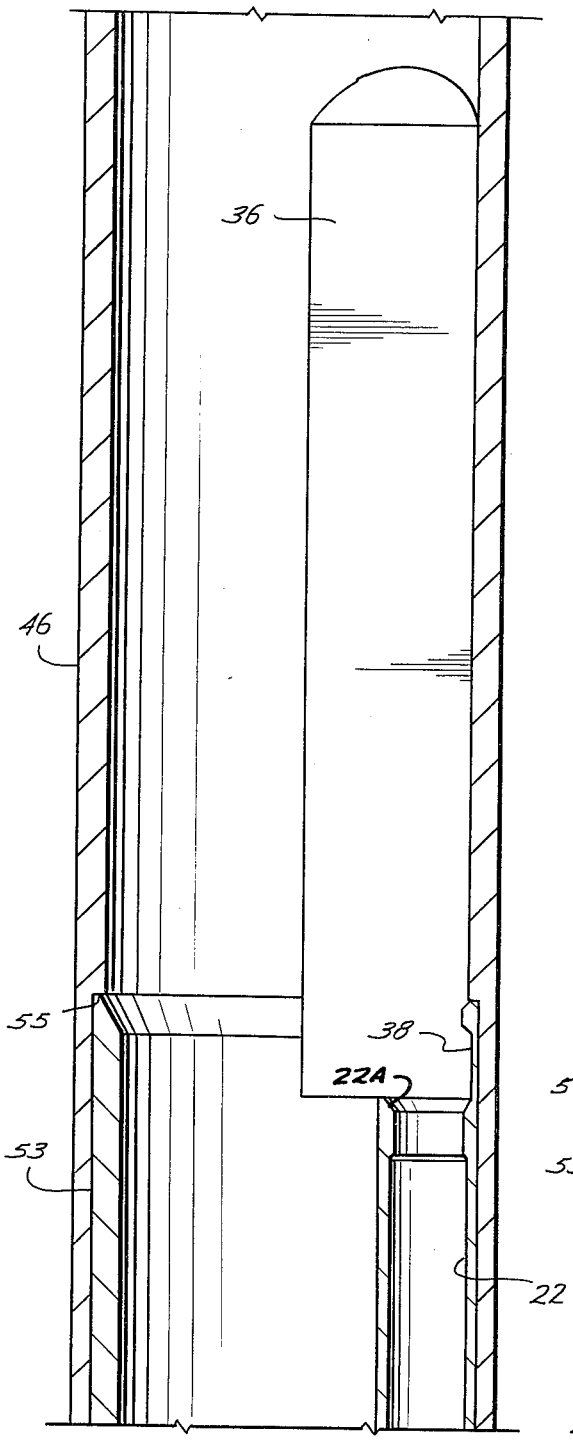
Figure 4C:
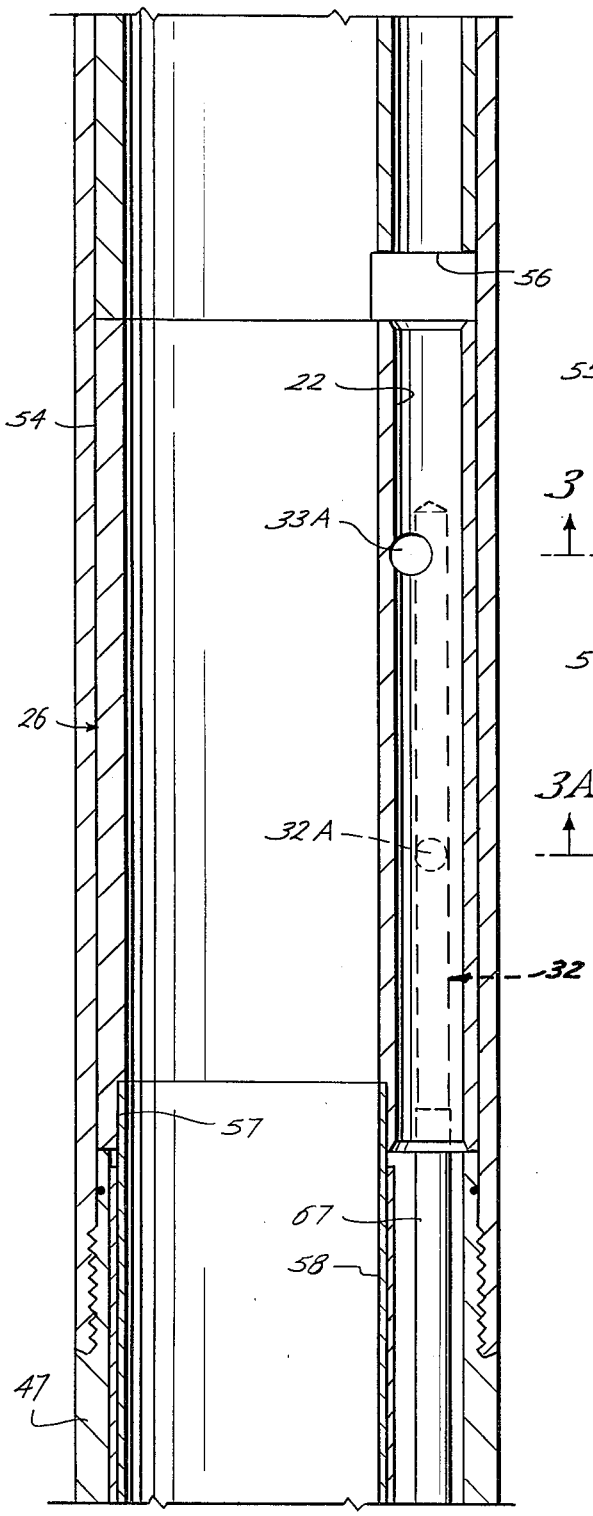
Figure 4D:
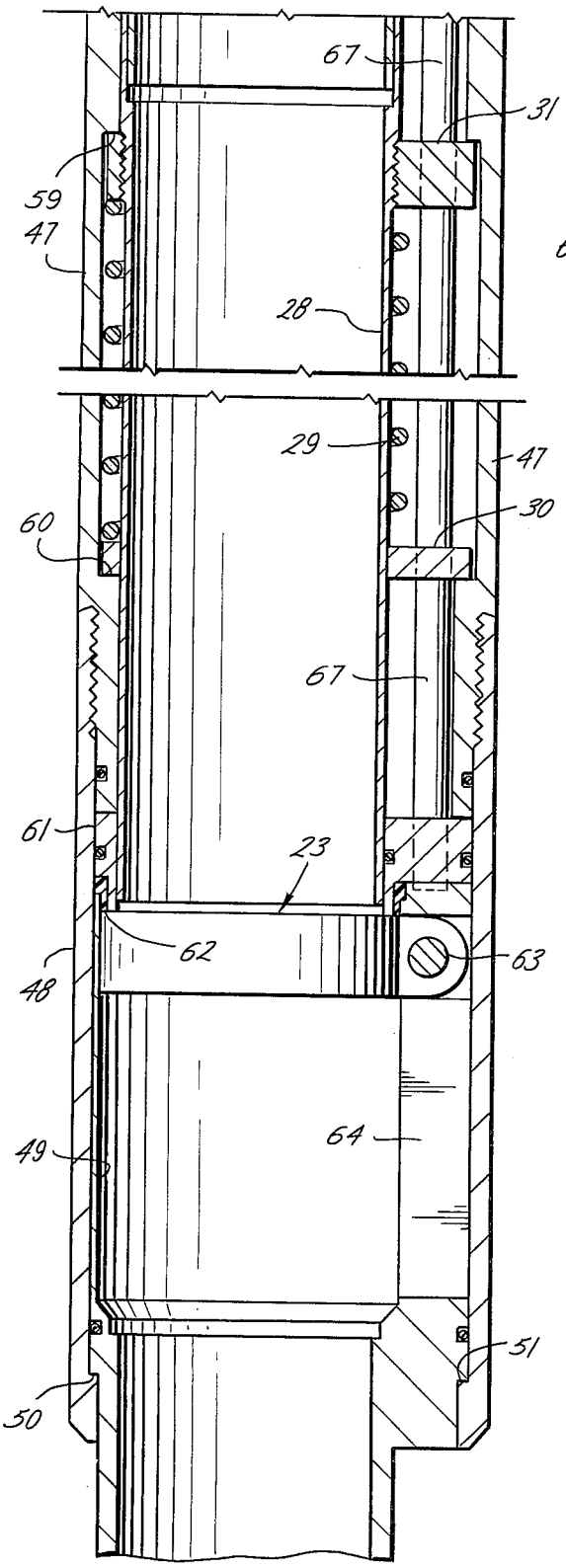

As shown in FIG. 4B, the upper section 53 is recessed on one side to receive the lower ends of the inserts providing the guide surfaces 36 at the entrance to the open upper end of the bore 22. The lower end of the upper section 53 is also cut out at 56 so as to interrupt the pocket 22 along its length at a location opposite the port 33C (see FIGS. 2 and 6B) in the operating tool T when the operating tool is in landed position. In this manner, well fluid from the tubing beneath the flapper is free to flow directly into the bore of the mandrel when the equalizing valve is opened.

The lower end of the inner mandrel body section 54 is counterbored at 57 so as to receive the upper end of a guide sleeve 58 which extends downwardly within and is spaced from the inner diameter of intermediate outer body section 47 to provide an annular space in which the upper end of actuator tube 28 reciprocates as it moves between its upper and lower positions. As shown in FIG. 4D, collar 31 carried about the actuator tube 28 is adapted to engage a downwardly facing shoulder 59 about the inner diameter of outer body section 47 so as to locate the actuator tube in uppermost position under the urging of coil spring 29. The stop ring 30 carried within the space between the tube 28 and the outer mandrel body section 47 is urged downwardly by the spring 29 into engagement with a stop shoulder 60 on the inner diameter of section 47.

A ring 61 is located within the space between the tube 28 and the tubular section 48 of the outer mandrel body so as to provide a guide for the lower end of tube 28. A seal ring of resilient material is disposed between a downward extension of the inner diameter of the ring 61 and the inner diameter of the upper end of the housing 49 to form a seat 62 against which the flapper 23 seats in its closed position. The seat ring 61 is held between the upper end of the flapper assembly housing 49 and the lower end of the outer mandrel body section 47.

As previously described, the upper portion of the flapper assembly housing 49 is like the inner mandrel body sections and lower end of outer mandrel body member 45 in that the axis of the bore therethrough is eccentric to its outer diameter. The flapper 23 is pivotally mounted on a pin 63 carried by the thickened wall of the housing 49 for swinging into and out of a slot 64 in the housing beneath the pin. When disposed within the slot, the flapper is out of the way of actuator tube 28 to permit the tube to move through the bore of the housing and thus, when fully lowered, to form a continuation of the bore through extension 52. As shown in FIG. 5D, the pivot pin 63 is surrounded by a torsion spring 65 which bears at one end on the flapper and at the other end on the flapper assembly housing 49 so as to yieldably urge the flapper to the closed position.

Each of the rings 30, 31 and 61 disposed within the space between actuator tube and the outer mandrel body are shaped similarly to the inner mandrel body sections, the flapper assembly housing 49, and the lower end of the outer mandrel body member 45 in that the axes of the openings or bores therethrough are eccentric with respect to their outer diameters. Thus, each such ring also has holes through a thickened wall thereof to guidably receive conduit 33 as well as the lower extension of conduit 32.

Figure 5B:
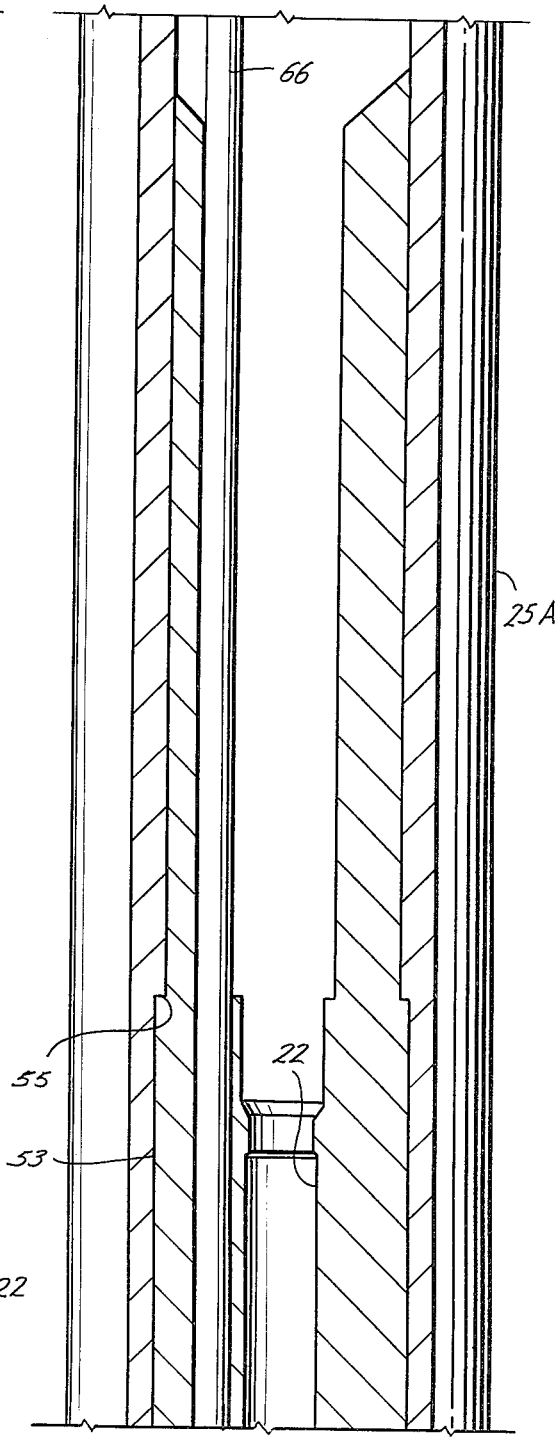
Figure 5C:
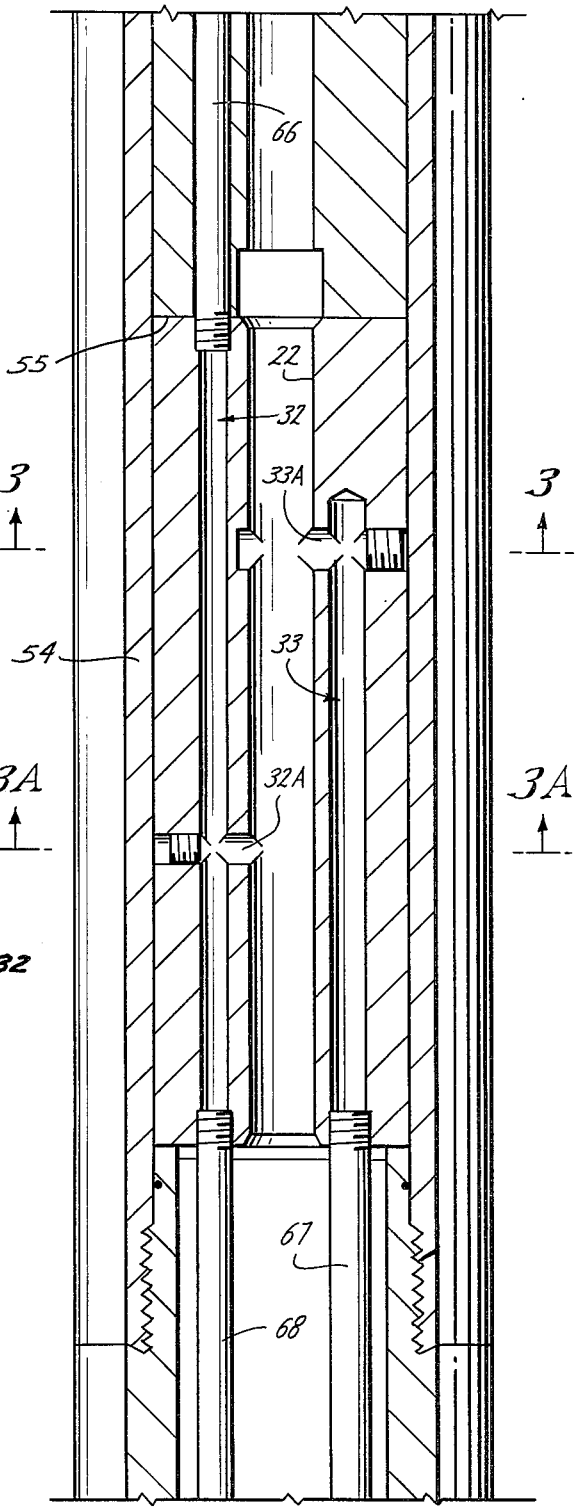
Figure 5D:
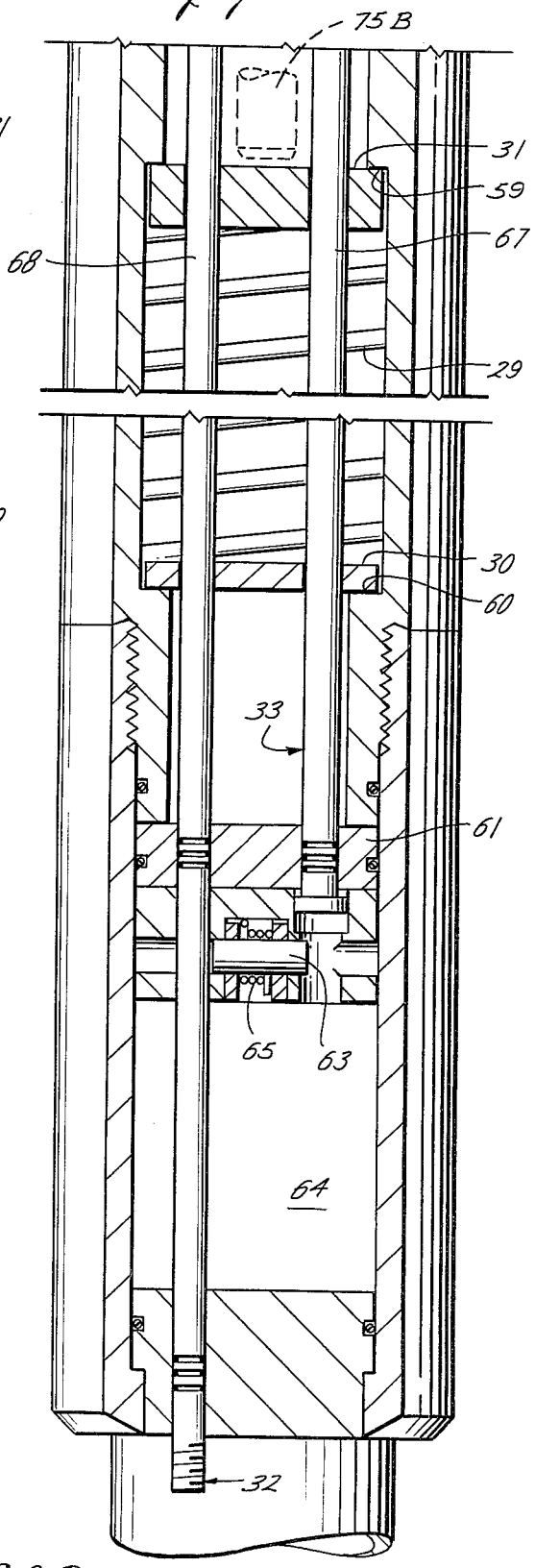

The portions of control fluid conduit 32 and tubing pressure equalizing conduit 33 which connect with pocket 22 include holes drilled in the thickened wall of the lower section 54 of the inner mandrel body on opposite sides of the pocket (see FIG. 5C). The upper end of conduit 32 includes a tube 66 connected at its lower end to an upper extension of the drilled hole in the lower section and extending upwardly through aligned holes in the upper section 54 of the inner mandrel body and the insert thereabove forming one of the guide surfaces 36 into and through the thickened wall of the lower end of outer mandrel body section 45. The lower end of conduit 33 comprises a tube 67 connected at its upper end to the lower end of the drilled hole in the lower section 54 and extending downwardly within the space between the actuator tube and the outer mandrel body through the rings 31, 30 and 61.

As shown in FIG. 5D, holes in the upper end of housing 49 connect the lower end of conduit 33 to the slot 64 opening to the bore of the mandrel beneath the closed flapper, and thus to the tubing below the mandrel. On the other hand, the portion of the conduit 32 above upper end of tube 66 which projects above the thickened wall of outer mandrel body section 45 (see FIG. 5A) may be continued upwardly along the side of the tubing string above the mandrel for connection to a source of control fluid at surface level or other remote location.

As shown in FIG. 5C, the hole which forms the lower end of conduit 32 leading to pocket 22 and the upper end of the lower extension of conduit 32 is drilled through the lower section 54 of the inner mandrel body. A tube 68 connecting with the lower end of this drilled hole extends downwardly within the space between the actuator tube and the outer mandrel body and through the rings 31, 30 and 61 in side-by-side relation with tube 67 (see FIG. 5D). However, the lower end of tube 68 continues to extend downwardly through the slot 64 and the thickened wall of the flapper assembly housing 49, and thus along the housing extension 52 and the tubing string below the mandrel for connection to other parts below the subsurface safety valve which may be operated by the control fluid. Obviously, the lower end of flapper 23 may be slotted or grooved to receive the extension of tube 68 as the flapper swings into the slot 64.

Figure 6A:
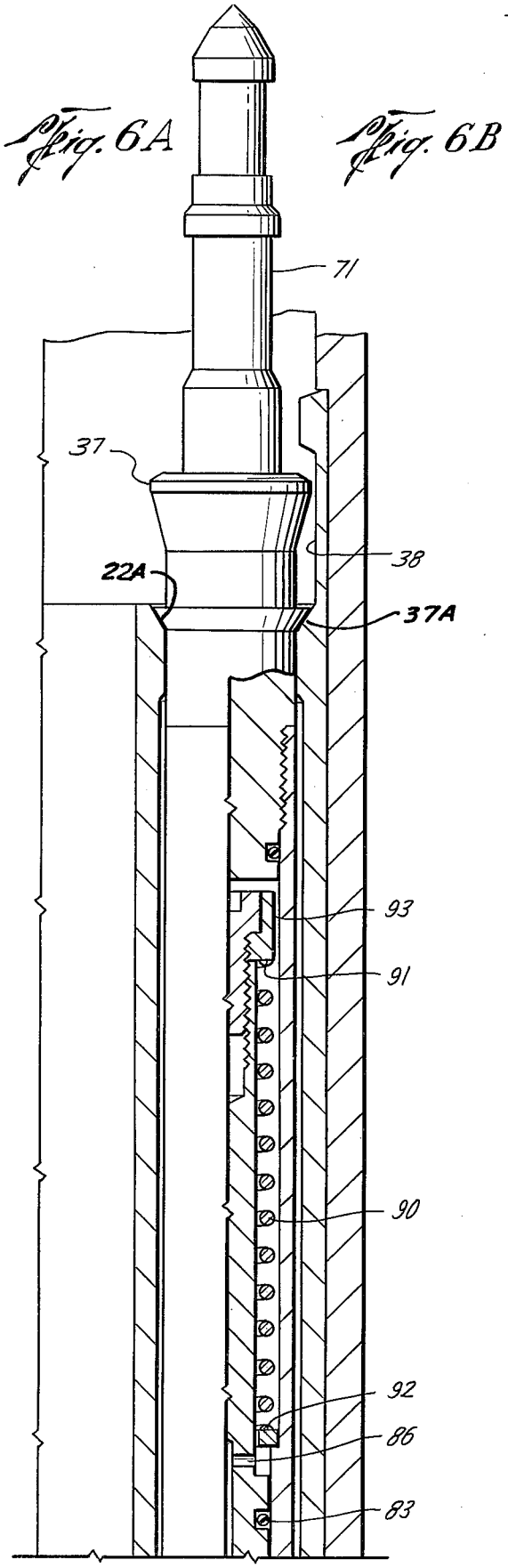
FIGS. 6A, 6B and 6C are partial vertical, sectional views similar to but on a larger scale than FIGS. 5A, 5B, 5C and 5D, and with the operating tool landed within the pocket of the mandrel of the tool.
Figure 6B:
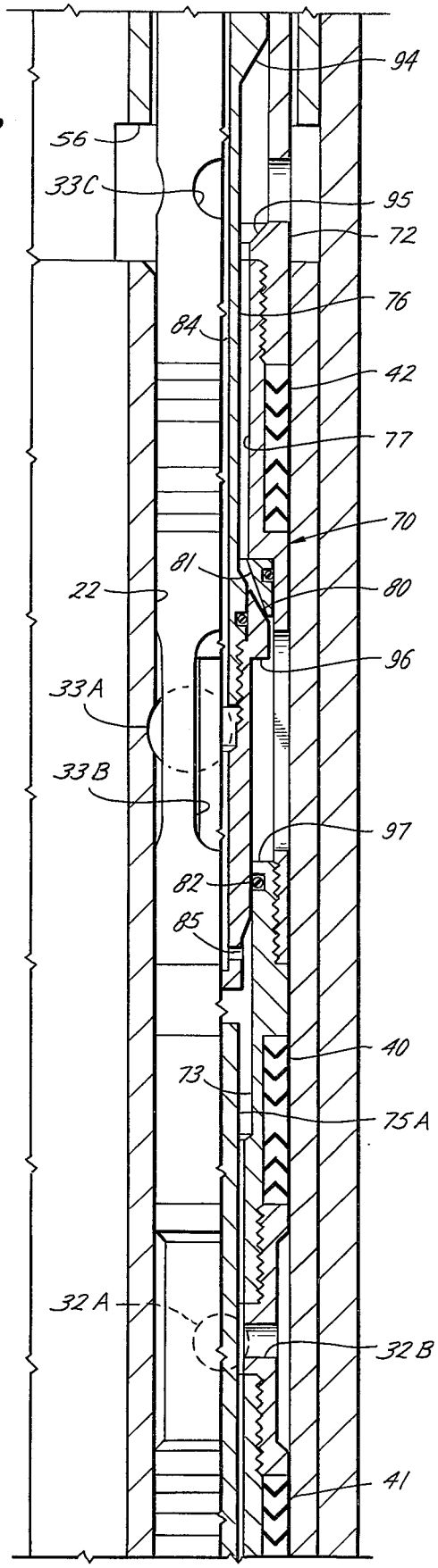
Figure 6C:
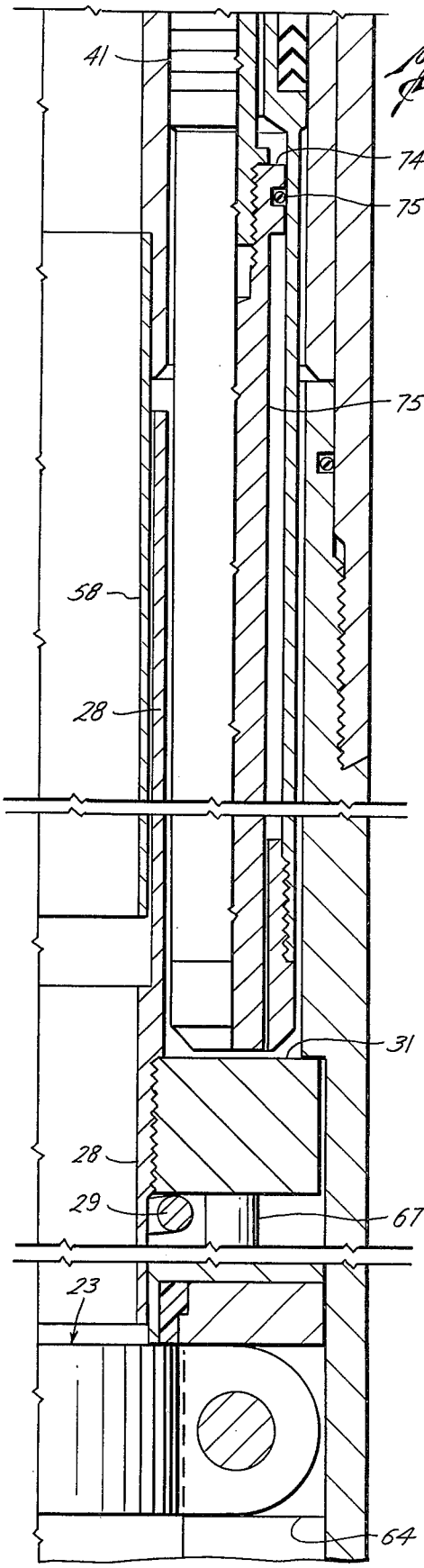

Operating tool T comprises a generally tubular body depending from the lower end of a fishing neck 71 at its upper end, and, as shown in FIGS. 6A, 6B and 6C, made up of a series of threadedly connected tubular sections about which the upper, lower and intermediate packings 42, 41 and 40, respectively, are carried for sealably engaging with the pocket 22 when the tool is landed therein. As previously described, the intermediate and lower packings 40 and 41 surround the tool body above and below port 32B therein and sealably engage the pocket above and below the port 32A in the mandrel so as to confine the flow of control fluid from conduit 32 through port 32B into the interior of the tool body. The upper and intermediate packings 42 and 40 surround the tool body above the below the slots 33B therein and sealably engage the pocket above and below the port 33A, and the upper packing 42 surrounds the tool body beneath port 33C and seals with the pocket 32 beneath the cutout 56. Thus, as will be described to follow, when the equalizing valve is open, well fluid in the tubing beneath the flapper is confined for flow into the tubing above the flapper.

As shown in FIGS. 6A, 6B and 6C, port 32B in the tubular body of the operating tool connects with a control fluid chamber 73 which is closed at its lower end by the pressure responsive surface on the upper side of the piston 74, and at its upper end by a dome in the closed upper end of the tubular body beneath the fishing neck thereof (see FIG. 6A). The piston carries an O-ring 75 thereabout which is sealably slidable within the tubular body during extension and retraction of the piston with respect thereto, as will be described to follow.

The equalizing valve includes a body 76 which is sealably slidable longitudinally within the tubular tool body for reciprocation above the piston 74 between positions opening and closing an annular conduit 77 between the body 76 and the tubular tool body. More particularly, and as will be described to follow, the tubular body 76 of the equalizing valve is reciprocated between opened and closed positions in response to the pressure of control within the control chamber.

As shown in FIG. 6B, an intermediate portion of the equalizing valve 76 is radially enlarged to provide a shoulder 80 which, in the closed position of the equalizing valve, seats upon the lower end of a seat 81 on the inner diameter of the tubular body 70 just above slots 33B. The lower end of the equalizing valve body beneath shoulder 80 slides within an O-ring 82 carried on the inner diameter of the tubular tool body beneath the slots 33B, and a radially enlarged portion of the equalizing valve body above shoulder 80 carries a seal ring 83 which sealably engages the inner diameter of the tubular tool body above the ports 33C. A passageway 84 through the equalizing valve body 76 connects with ports 85 in its lower end beneath O-ring 82 and with ports 86 in an intermediate portion thereof above O-rings 83, so as to provide a bypass for control fluid between the lower end of the chamber below the valve to the upper end of the chamber.

As shown in FIGS. 6B and 6C, the piston 75 has an upward extension 75A whose upper end is spaced a short distance below the lower end of equalizing valve body 76, when the valve is closed and the piston is retracted, and a lower extension 75B which extends downwardly within the lower end of the tubular body of the operating tool. In a manner to be described, the piston reciprocates between an upper, retracted position in which its lower end is substantially flush with the lower end of the tool body (FIG. 6C), and a lower, extended position in which its lower end projects beyond the lower end of the tool body to engage and lower the actuator tube 28 in order to open the flapper. As shown in FIG. 6C, the lower ends of both the tool body and piston extension 75B are spaced a short distance above the upper end of collar 31 on the actuator sleeve, to enable the operating tool to be landed without preloading the spring 29.

As will be understood, piston 74 has opposite facing, pressure responsive surfaces of equal area on its upper and lower sides which are acted upon by control fluid and well fluid within the well tubing above the flapper. Thus, as control fluid is supplied to chamber 73 at a pressure sufficient to overcome the force due to pressure in the tubing, the lower end of the piston will be extended below the lower end of the tool body to engage the collar 31. As the pressure of the control fluid is further increased to overcome the force of spring 29, the piston lowers collar 31 until the lower end of the actuator tube 28 engages the top side of flapper 23, as shown in FIG. 7. At this time, however, the upward force which the well tubing pressure beneath the flapper is exerting on the closed flapper prevents further downward movement of the actuator tube until the pressure across the flapper is equalized.

For purposes which will be understood from the description to follow, body 76 of the equalizing valve is yieldably urged to its upper seated position by means of a coil spring 90 arranged within the upper annular portion of the upper end of control chamber 73 between the upper end of the equalizing valve body and the tubular extension of the body of the operating tool beneath the fishing neck at its upper end. As shown in FIG. 6A, the lower end of the coil spring engages a ring 92 seated upon an upwardly facing shoulder on the inner diameter of the tool body, and the upper end of the spring engages a shoulder on the lower end of an enlarged head 93 of the equalizing valve body.

The outer diameter of the O-ring 83 is larger than the inner diameter of the O-ring 82 so that control fluid is effective over an annular cross-sectional area to urge the equalizing valve body 76 in a downward direction. The area of the seating surface of the shoulder 80 on the equalizing valve body is larger than either of the aforementioned areas, so that, with the flapper closed, the pressure of well fluid in the tubing beneath the flapper will urge the equalizing valve body in an upward direction to seat with a force equal to such pressure times the difference in area between the seating surface and the inner diameter of O-ring 82, plus the force of the spring 90 urging the equalizing valve body in an upward direction. Hence, even if the upward force of the spring 90 is ignored, the tubing pressure below the closed flapper will maintain equalizing valve closed until control pressure has been raised to a level sufficiently higher than that of the tubing pressure (depending on the relationship of the areas of the seating surface and within the O-ring 82), and, in any event, to a level higher than that required to move the piston 75 downwardly to cause the actuator tube to engage the top of the flapper. Thus, as previously described, the piston is so moved in response to a control pressure which may be only slightly greater than that of tubing pressure above the flapper, which in turn is normally substantially less than tubing pressure beneath the flapper.

With the lower end of the actuator tube 28 engaged with the top side of the closed flapper 23, as shown in FIG. 7, and control pressure raised to move the equalizing valve body downwardly, and thus open the lower end of conduit 77, well fluid in the tubing beneath the flapper begins to bypass the operating tool through the annular conduit 77 and into the bore of the mandrel above the flapper through ports 33C, whereby pressure in the tubing above and below the flapper begins to equalize. As will be understood from the description to follow, downward movement of the equalizing valve body 76 is limited by engagement of its lower end with the upper end of piston extension 75A (see FIG. 7) so that the tubing pressure continues to equalize, whereby the piston is able to extend further so as to lower actuator tube 28 and thus swing flapper 23 to open position, as shown in FIG. 8.

As the piston 75 is lowered, the equalizing valve body 76 also moves downwardly until a tapered shoulder 94 thereabout beneath the O-ring 83 seats upon an upwardly facing tapered seat 95 on the inner diameter of the tubular body of the operating tool just above the ports 33C to reclose the valve. In this respect, it will be understood that the travel of the equalizing valve body is less than the travel of the piston or the distance between a shoulder 96 on the lower end of the enlargement of the equalizing valve body beneath shoulder 80 and the upper end of a shoulder 97 on the inner diameter of the tube body just above the seal ring 82. Since the shoulder 94 and seat 95 engage beneath the ports 33C, they prevent debris from entering the annular bypass conduit 77, and thus protect the dynamic seals of the tool therebelow as well as the seating surfaces between the equalizing valve and the inner diameter of the tool body.

The above-identified apparatus is "fail safe" in the sense that each of the flapper and equalizing valve will either remain closed or, if open, will close automatically in response to abnormal conditions, including the loss of control fluid, as may occur upon shearing of the tubing and control fluid conduit 32, whereby water entered the lower portion of the control line and thus the control chamber, and/or the failure of one or more of the seals carried by or within the operating tool such that well fluid in the tubing beneath the flapper entered the control chamber 73.

For example, the flapper would either remain or fail closed because coil sring 29 is of such strength as to overcome a force due to the hydrostatic pressure of the water acting on the upper end of the piston 75. Also, although the hydrostatic pressure of the water would also produce a downward force on the equalizing valve (due to the difference in the effective pressure responsive areas of seal rings 82 and 83), spring 90 is of such strength as to produce a greater upward force.

In like manner, even if packing 40 fails while the flapper is closed, so that high pressure in the tubing beneath the flapper enters the control chamber 73, neither the flapper nor the equalizing valve would open unless the tubing pressure exceeded the pressure of the control fluid (or hydrostatic pressure of water in the event of loss of control fluid). Normally, the equalizing valve will remain closed due to the fact that, as previously noted, the high pressure fluid in the tubing beneath the closed flapper acts over a net pressure responsive area of the equalizing valve body which urges it closed.

In the event control fluid is lost, and the packing 40 fails, when the flapper is in open position, the spring 29 will move the flapper to closed position due to the force of spring 29. This of course results from the fact that the tubing pressure above and below the flapper is equalized so that the spring 29 is the only force acting upon the piston to urge it to its upward position.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A subsurface safety valve, comprising a mandrel having a bore therethrough whose axis is adapted to be substantially aligned with the axis of a tubing string when the mandrel is connected as part of the string, and a pocket to one side of the bore having an end which opens to the bore, a closure member mounted within the mandrel for movement between positions opening and closing the bore, means yieldably urging the closure member to its closed position, a tool adapted to be moved vertically through the tubing string and open end of the pocket into and out of a landed position within the pocket, and including means which is responsive to the supply of control fluid thereto, when said tool is landed in the pocket, for moving the closure member to open position, and means through which control fluid may be supplied from a remote source to said closure member moving means.

2. A valve of the character defined in claim 1, including means comprising conduits within the tool and the mandrel for fluidly connecting the mandrel bore above and below the closure member so as to equalize pressure thereacross when the closure member is closed, and means within the tool which normally closes the conduits but which opens them automatically in response to the supply of control fluid but prior to opening of the closure member.

3. A valve of the character defined in claim 2, wherein said means which opens the conduits also includes means for reclosing them when the closure member is opened to equalize pressure thereacross.

4. A subsurface safety valve, comprising a mandrel having a bore therethrough whose axis is adapted to be substantially aligned with the axis of a tubing string when the mandrel is connected as part of the string, and a pocket to one side of the bore having an end which opens to the bore, a closure member mounted within the mandrel for movement between positions opening and closing the bore, means yieldably urging the closure member to its closed position, a tool comprising a body adapted to be moved vertically through the tubing string and open end of the pocket into and out of a landed position within the pocket, and including means which, when the body is landed within the pocket, forms a control fluid chamber, and a piston having one side which is responsive to control fluid in said chamber for urging it in one direction to open the closure member and an opposite side which is responsive to the pressure of well fluid in the bore of the mandrel for urging it in the opposite direction to permit the closure member to be closed, and means including a port in the mandrel connecting with the pocket to permit control fluid to be supplied to said chamber from a remote source.

5. A valve of the character defined in claim 4, including an actuator mounted within the mandrel for movement by said piston in one direction to open the closure member and in another direction to permit the closure member to close.

6. A valve of the character defined in claim 5, wherein the actuator comprises a tube which is axially reciprocable within the bore and which is yieldably urged in said other direction.

7. A valve of the character defined in claim 4, including means comprising conduits within the tool body and the mandrel for fluidly connecting the mandrel bore above and below the closure member so as to equalize pressure thereacross when the closure member is closed, and means within the tool body which normally closes said conduits but which opens them automatically in response to the supply of control fluid to the control fluid chamber at a pressure sufficient to move said piston but prior to opening of the closure member.

8. A valve of the character defined in claim 7, wherein said means which opens the conduits also includes means for reclosing them when the closure member is opened to equalize pressure thereacross.

9. A subsurface safety valve, comprising a mandrel having means at its opposite ends for connecting it as part of a tubing string and a bore therethrough adapted to be substantially aligned with the axis of the string when the mandrel is so connected, said mandrel having a radially enlarged portion intermediate its ends whose outer diameter is eccentric to the axis of its bore, a closure member mounted within the mandrel for opening and closing the bore, means yieldably urging the closure member to closed position, means forming a control fluid chamber within the thickened wall of the intermediate portion of the mandrel, a piston having one side which is responsive to control fluid within the chamber to urge said piston in a direction to move said closure member to open position, and means through which control fluid may be supplied to the control fluid chamber from a remote source.

10. A valve of the character defined in claim 9, wherein the means through which control fluid may be supplied includes a conduit extending within said thickened wall to connect with the control fluid chamber.

11. A valve of the character defined in claim 10, including means including another conduit in said thickened wall through which well fluid from the bore of the mandrel beneath the closure member may communicate with the bore thereabove, and means which normally closes said other conduit but opens in response to the supply of control fluid to said chamber following movement of said closure member to open position to equalize pressure thereacross.

12. A valve of the character defined in claim 10, wherein another conduit is formed in the thickened wall to provide a continuation of said first-mentioned conduit and through which control fluid may be supplied to parts beneath the closure member.

13. A subsurface safety valve, comprising a mandrel having means at its opposite ends for connecting it as part of a tubing string and a bore therethrough adapted to be substantially aligned with the axis of the string when the mandrel is so connected, said mandrel having a radially enlarged portion intermediate its ends whose outer diameter is eccentric to the axis of its bore, a closure member mounted within the mandrel for opening and closing the bore, means yieldably urging the closure member to closed position, a pocket within the thickened wall of the intermediate portion of the mandrel and having one end which opens to the bore of the mandrel, a tool adapted to be moved vertically through the tubing string and open end of the pocket into and out of a landed position within the pocket, and including means which is responsive to the supply of control fluid thereto, when said tool is landed in the pocket, for moving the closure member to open position, and means through which control fluid may be supplied from a remote source to said closure member moving means.

14. A valve of the character defined in claim 13, including means comprising conduits within the tool and the mandrel for fluidly connecting the mandrel bore above and below the closure member so as to equalize pressure thereacross when the closure member is closed, and means within the tool which normally closes the conduits but which opens them automatically in response to the supply of control fluid but prior to opening of the closure member.

15. A valve of the character defined in claim 14, wherein said means which opens the conduits also includes means for reclosing them when the closure member is opened to equalize pressure thereacross.

16. A well tool, comprising a mandrel having an outer body with openings through its upper and lower ends which are adapted to be connected in substantial axial alignment with a well pipe string, and an intermediate section whose inner diameter is eccentric to the axes of the end openings, an inner body within the inner diameter of the intermediate section of the outer body having a bore therethrough whose axis is substantially aligned with the axes of the end openings and a pocket which is formed therein to one side of the bore with its axis substantially parallel to the axis of said bore, and means threadedly connecting the inner body in a fixed vertical position within the outer body, said pocket having an end which is open to the intermediate section of the outer body, whereby a wire line tool may be run into and retrieved from a landed position within the pocket.

* * * * *